US006135162A

United States Patent [19]

Dornier et al.

[11] Patent Number: 6,135,162

[45] Date of Patent: Oct. 24, 2000

[54] METHOD AND DEVICE FOR REGULATING A BACK REST AND/OR A DROP WIRE POSITION OF A WEAVING MACHINE

[75] Inventors: Peter D. Dornier, Nonnenborn; Herbert Mueller, Kressbronn; Stefan Arndt, Lindau, all of Germany

[73] Assignee: Lindauer Dornier Gesellschaft mbH, Lindau, Germany

[21] Appl. No.: 09/308,068

[22] PCT Filed: Sep. 4, 1998

[86] PCT No.: PCT/DE98/02610

§ 371 Date: May 13, 1999

§ 102(e) Date: May 13, 1999

[87] PCT Pub. No.: WO99/14410

PCT Pub. Date: Mar. 25, 1999

[30] Foreign Application Priority Data

Sep. 13, 1997 [DE] Germany ..... 197 40 309

[51] Int. Cl.[7] ..... D03D 49/04; D03D 51/20

[52] U.S. Cl. ..... 139/110; 139/114; 139/358; 700/140; 364/921.1

[58] Field of Search ..... 139/110, 358, 139/114; 700/140; 364/921.1

[56] References Cited

U.S. PATENT DOCUMENTS

| | | | |
|---|---|---|---|
| 3,395,736 | 8/1968 | Nishikawa . | |
| 4,338,972 | 7/1982 | Sherrill . | |
| 4,534,386 | 8/1985 | Pfarrwaller . | |
| 4,754,784 | 7/1988 | Senn . | |
| 5,014,756 | 5/1991 | Vogel et al. | 139/114 |
| 5,060,161 | 10/1991 | Sainern | 139/105 |
| 5,090,453 | 2/1992 | Stacher et al. . | |
| 5,220,945 | 6/1993 | Vandeweghe et al. . | |
| 5,261,463 | 11/1993 | Sato | 139/114 |
| 5,549,140 | 8/1996 | Lindblom | 139/105 |
| 5,558,132 | 9/1996 | Haeussler et al. . | |
| 5,562,128 | 10/1996 | Haeussler et al. . | |
| 5,755,268 | 5/1998 | Arndt et al. . | |
| 5,890,519 | 4/1999 | De Jager et al. | 139/115 |

FOREIGN PATENT DOCUMENTS

| | | |
|---|---|---|
| 0109472 | 5/1984 | European Pat. Off. . |
| 0191315 | 8/1986 | European Pat. Off. . |
| 0231726 | 8/1987 | European Pat. Off. . |
| 0350447 | 1/1990 | European Pat. Off. . |
| 0396501 | 11/1990 | European Pat. Off. . |
| 0495984 | 7/1992 | European Pat. Off. . |
| 0547003 | 6/1993 | European Pat. Off. . |
| 0841418 | 5/1998 | European Pat. Off. . |
| 3532798 | 4/1986 | Germany . |
| 4422640 | 1/1995 | Germany . |
| 2009260 | 6/1979 | United Kingdom . |

*Primary Examiner*—Andy Falik
*Attorney, Agent, or Firm*—W. F. Fasse; W. G. Fasse

[57] ABSTRACT

In a loom of which the backrest (3) and/or the warp stop motion (17) are adjustably supported on the machine frame (22) and are adjustable by associated adjusting equipment with at least one adjusting function, at least the backrest (3) and/or the warp stop motion (17) are automatically adjusted. To achieve this, at least one controllable driven adjusting device (30) connected to the loom control is allocated to the adjusting equipment. The existing actual position of the backrest and/or of the warp stop motion is determined. At least the measured values characteristic of the actual position are compared to prescribed nominal or desired values. From this comparison, an adjusting signal is generated, which is then provided to the adjusting device, which then automatically moves the backrest (3) and/or the warp stop motion (17) automatically into the respective desired position.

25 Claims, 5 Drawing Sheets

METHOD AND DEVICE FOR REGULATING A BACK REST AND/OR A DROP WIRE POSITION OF A WEAVING MACHINE

FIELD OF THE INVENTION

The invention relates to a method for adjusting a backrest and/or a warp stop motion of a weaving loom, of which the backrest and/or the warp stop motion are adjustably supported on the machine frame and are movable from an actual position into a respective prescribed nominal or desired position and fixable in this desired position by allocated adjusting means with at least one adjusting function.

BACKGROUND INFORMATION

For producing a woven cloth, the warp threads of the warp must be divided into an upper shed and a lower shed starting from the so-called binding point to the weaving reed, in order to carry out a weft insertion. This is achieved by heald shafts in heald shaft looms and by harness cords in jacquard looms.

The resulting angles between the warp threads bounding the loom shed in this context are directly dependent on the position of the backrest and the stroke of the heald shafts (harnesses). These angle relationships of the loom shed are important for the weaving operation and are different for different woven cloths. That generally means that the position of the backrest must be changed and newly adjusted in connection with a change of the woven cloth to be produced (product article change). A similar consideration often pertains also to the so-called warp stop motion, of which it is the object to monitor the warp for warp a thread breaks and to stop the loom upon the occurrence of a warp thread break.

An uncontrolled tensioning unit for the warp of a weaving loom is known from German Patent Publication DE 195 38 121 C1 and corresponding U.S. Pat. No. 5,755,268 (Arndt et al.), which basically shows how the tensioning unit, which includes a backrest roller (backrest beam), is supported on the loom frame in a manner so as to be adjustable in a horizontal and vertical direction. The tensioning unit is supported on both sides on two carriage-like components, which are longitudinally slidably guided on two guide parts, which in turn are supported on the side cheeks of the loom frame so as to be tiltable about a common horizontal axis. Clamping screws cooperating with corresponding elongated or slotted holes make it possible to position the tensioning unit and therewith the backrest roller into the optimum desired position for the respective woven cloth to be produced. In this context, the adjustment of the tensioning unit is carried out by hand.

Because this adjustment of the backrest beam requires a certain degree of care, a loom known from U.S. Pat. No. 5,261,463 (Sato) has already been equipped with an arrangement for monitoring or checking the correct positioning of the tensioning unit for the warp. The backrest beam of the loom is supported on the machine frame on each side of the machine by means of two carriage-like bearing parts that are movable at right angles to each other. Clamping screws reaching through elongated or slotted holes make it possible to move the backrest beam, which is adjustable in the horizontal direction and in the vertical direction in this manner, into its respective desired position, and then to fix it in this position. The operation of the clamping screws and the adjusting of the backrest beam from the actual position into the desired position are carried out by hand. Non-Contacting or contactless optical sensors are allocated to the carriage-like bearing parts on each side of the machine, wherein these sensors determine the horizontal and vertical position of the backrest beam and provide corresponding data into a control unit, where these data are stored and then caused to be displayed on a display screen. An operator can thereby follow the adjustment process on the display screen, whereby the attainment of a prescribed desired position is indicated by light signals. Nonetheless, the adjustment of the backrest beam comprising two rollers remains time consuming, because on each side of the machine a plurality of clamping screws must be loosened by hand and then must again be retightened by hand after the similarly manually conducted process of moving the backrest beam into the respective desired position. As a side comment, a similar consideration pertains also to the warp stop motion, in case such an arrangement is provided.

SUMMARY OF THE INVENTION

In view of the above, it is an object of the invention to provide an arrangement and a method that allow a rapid and precise adjustment of the backrest and/or the warp stop motion in a loom.

The above object has been achieved according to the invention in a method for adjusting the position of a weaving loom's backrest and/or warp stop motion, which are adjustably supported on the machine frame of the loom so as to be movable from an existing actual position to a prescribed desired position by allocated adjusting means with at least one adjusting function. The above object has further been achieved in an apparatus according to the invention.

The term "backrest" in the scope of the invention is not limited to a single backrest beam or roller, but instead it also encompasses such embodiments in which the function of the backrest for tensioning and deflecting the warp is distributed among several rollers, which may in a particular case be grouped together into a tensioning unit, as this is shown, for example, in the above mentioned German Patent Publication DE 195 38 121 C1 and corresponding U.S. Pat. No. 5,755,268.

In the inventive method, at least one controllable driven adjusting device is allocated to or included in the adjusting means and makes it possible to achieve the necessary adjusting movements for example in the horizontal and/or vertical direction. In an adjusting process, first the respective adjusting function of the adjusting means is recognized, i.e. it is recognized whether the adjusting means will serve for achieving adjusting movements in for example the horizontal or the vertical direction. Moreover, the existing actual position of the backrest and/or the warp stop motion is determined. This actual position is automatically compared with a prescribed nominal or desired position for the respective adjusting function. From this comparison, an adjusting signal necessary for moving the backrest and/or the warp stop motion into the desired position is generated, and is then provided to the adjusting apparatus. Then the adjusting apparatus operates the adjusting means in the measure required for the adjustment. In this manner, the backrest and/or the warp stop motion are automatically positioned exactly into the respective desired position. The adjustment of the backrest can occur in common with or separately from the adjustment of the warp stop motion, in case such an arrangement is present in the loom.

For operating the individual adjusting functions, it is generally the rule to use a movable adjusting device that is removably coupled to the individual adjusting means and after completion of the adjusting process is again decoupled from the adjusting means.

In the apparatus according to the invention, the arrangement can be so fashioned for this purpose, that the adjusting device is embodied as a movable adjusting unit containing the drive, wherein this adjusting unit is removably coupleable with the operating means of the respective adjusting function. The adjusting means can comprise movably supported bearing parts, for example carriages, that are allocated to the individual adjusting functions, and that are respectively adjustable via a self-locking drive transmission and that contain a threaded spindle as operating means. The adjusting unit connected with its drive to the loom control is rotationally securely set successively onto the threaded spindles allocated to the individual adjusting functions. The adjusting unit recognizes the location and the function of the spindles by a coding arrangement. A contact-free measuring system on the adjusting unit, i.e. a measuring system that operates without physically contacting the part of which the position or distance is being measured, generally an ultrasonic sensor or a laser measuring unit, determines the existing distance position of the associated bearing part or carriage in connection with a fixed reflector or reflection plane and transmits the corresponding data to the loom control. In comparison with the adjustment values prescribed by an operator or provided via a data network, the drive of the adjusting apparatus is automatically correspondingly driven until the prescribed desired position value is reached.

In practice, the vertical adjustment range for the backrest adjustment by itself allows an adjustment of approximately 200 mm. Therefore, it is also necessary to be able to correspondingly move the warp stop motion. In the above mentioned embodiment with the self-locking drive transmissions and their operating means embodied as threaded spindles, there arise as a result in this context a total of four movably supported bearing parts (carriages) with associated threaded spindles on each respective side of the machine. Two threaded spindles serve for the vertical and horizontal adjusting of the backrest; while the two remaining threaded spindles allow the vertical and horizontal adjustment of the warp stop motion.

The invention enables a rapid and exact positioning of the backrest and/or the warp stop motion. Moreover, the achieved adjustments are reproducible for a renewed weaving of the same product article. Furthermore, in the inventive manner, the adjustments of the backrest and/or the warp stop motion can easily be altered during the weaving process, in other words during the weaving production for the purpose of optimizing the position adjustment. Such a change in the position adjustment of the backrest can also be used according to the invention to hold constant the geometry of the so-called back shed located between the heald shafts and the backrest, independently of the wrapping diameter of the warp beam, which necessarily varies during the progress of weaving. Namely, in looms in which the warp is pulled off over a spring-loaded backrest, the position of the backrest will change as the wrapping diameter of the warp beam diminishes during the weaving process, and therewith the geometry of the back shed that has been adjusted to the corresponding wrapping diameter also changes.

In a further embodiment of the invention it is therefore provided to store as a nominal or desired value in the control unit an optimal backrest position that has been achieved by the adjusting units of the backrest, to continuously determine as an actual value a change in the position of the backrest resulting from the diminishing warp beam wrapping diameter by a measurement technique using means that are generally known as such, to provide these actual values to the control unit by means of a signal transmission, and to maintain the desired or nominal adjustment of the backrest in the context of a continuously carried out actual/desired value comparison of the position variation, by a continuous readjustment or a successive time interval limited readjustment. In this case, the adjusting units of the horizontal and vertical carriages are units that are rigidly connected to the threaded spindles. Thereby it is advantageous that it is possible to avoid the necessity of carrying out an adaptation of the warp stop motion to the geometry of the back shed during the progress of weaving, because the entrance of the warp threads from the backrest into the warp stop motion is not changed in any case. In this manner, the uncontrolled movement of the warp stop motion drop wires is also held within limits and thereby the stopping behavior of the drop wires is not negatively influenced.

In the drawings, an example embodiment of the subject of the invention is illustrated, wherein:

FIGS. 1A, 1B and 1C respectively show a schematic view of the shed formation in a heald shaft loom while illustrating three different adjustments of the backrest;

DETAILED DESCRIPTION OF PREFERRED EXAMPLE EMBODIMENTS AND OF THE BEST MODE OF THE INVENTION

Figure 1A:
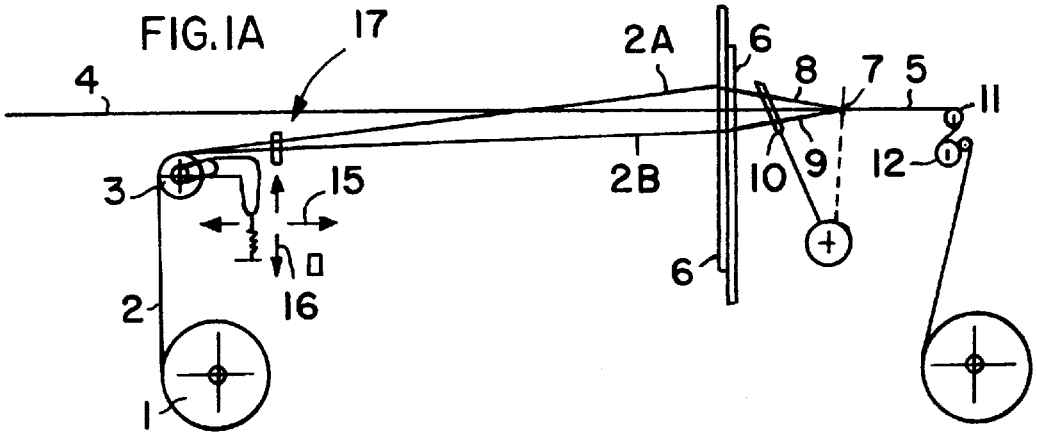
Figure 1B:
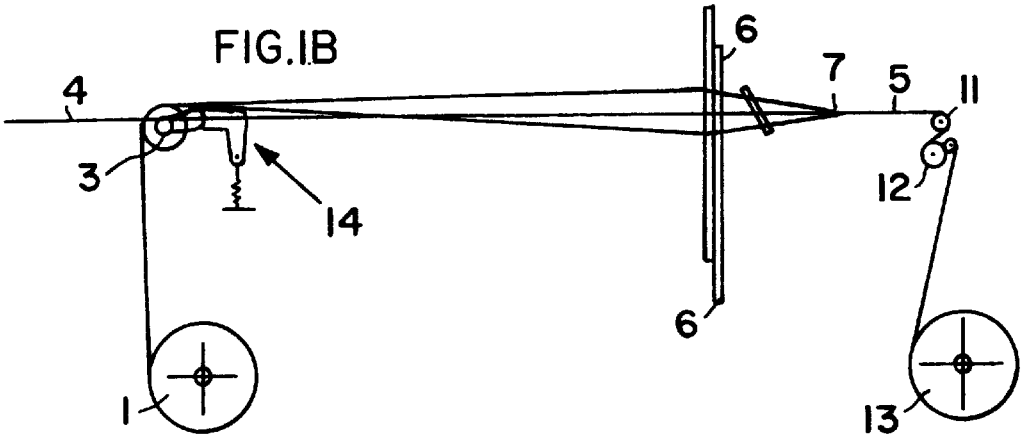
Figure 1C:
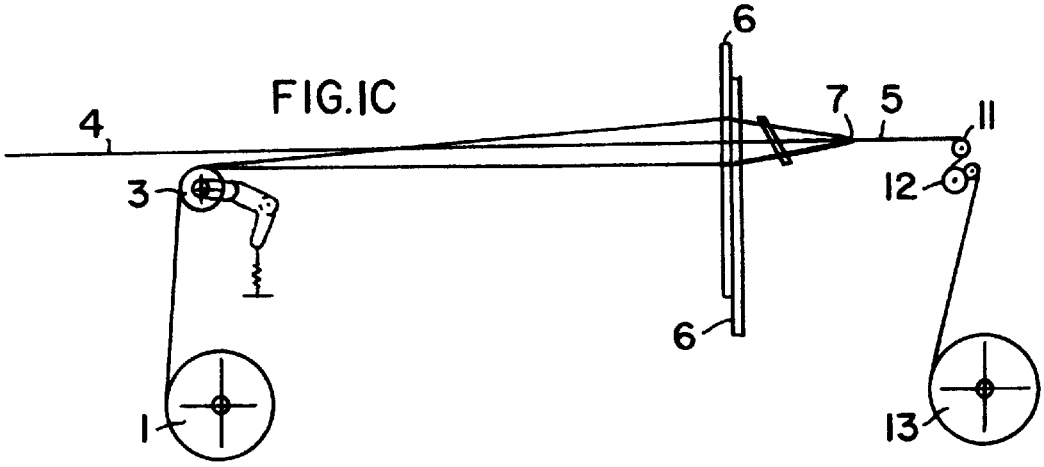

The basic construction of a loom is schematically illustrated in FIG. 1, comprising FIGS. 1A, 1B and 1C A warp referenced by 2 is guided from a rotatably supported warp beam 1 over a backrest 3, by means of which the warp threads of the warp 2 are deflected approximately into a horizontal plane 4, which contains the woven cloth 5 being produced. The warp threads 2*a,* 2*b* of the warp 2, beginning from the backrest 3, run through heddles of heald shafts 6 by means of which the warp threads 2*a,* 2*b* are divided into an upper shed 8 and a lower shed 9 beginning from the binding point referenced by 7, for enabling a weft insertion. The weaving reed of this loom is referenced by 10. The weft insertion elements are not further shown. The woven cloth 5 being produced is directed over a breast beam 11 and a riffle beam or fluted roller 12 to a cloth beam or roller 13 on which it is taken up.

As can be easily seen from a comparison of the different adjustments of the backrest 3 shown in FIGS. 1A, 1B and 1C respectively, the angles enclosed by the warp threads of the upper and lower sheds 8, 9 relative to each other and relative to the horizonal plane 4 are dependent on the position of the backrest 3 and the stroke of the heald shafts 6. Therefore, depending on the woven cloth 5 that is to be produced, the backrest 3 must be adjusted to a respective optimum desired position. Thus, adjusting means are allocated to the backrest 3 in the area of its bearing positions. backrest 3 cooperates with a warp tension compensating device indicated by 14. The adjusting means make it possible to adjust the backrest 3 in the horizontal direction and in the vertical direction, as is shown by arrows 15 and 16 respectively.

A warp stop motion indicated by 17, which is generally known as such, is provided near the backrest 3, and extends over the width of the loom so as to monitor the warp threads 2*a,* 2*b* of the warp 2 for warp thread breaks in the area between the backrest 3 and the heald shafts 6. In the even of the occurrence of a warp thread break, the warp stop motion stops the loom. Since the warp stop motion 17, for carrying out its proper function, must be in a prescribed arrangement relative to the warp threads, it is generally also necessary to correspondingly adjust the warp stop motion 17 whenever the backrest 3 is adjusted. For this purpose, the warp stop motion 17 is similarly equipped with allocated adjusting means at its bearing positions on the machine frame, whereby these bearing means will be described in detail in connection with FIG. 3.

Figure 2:
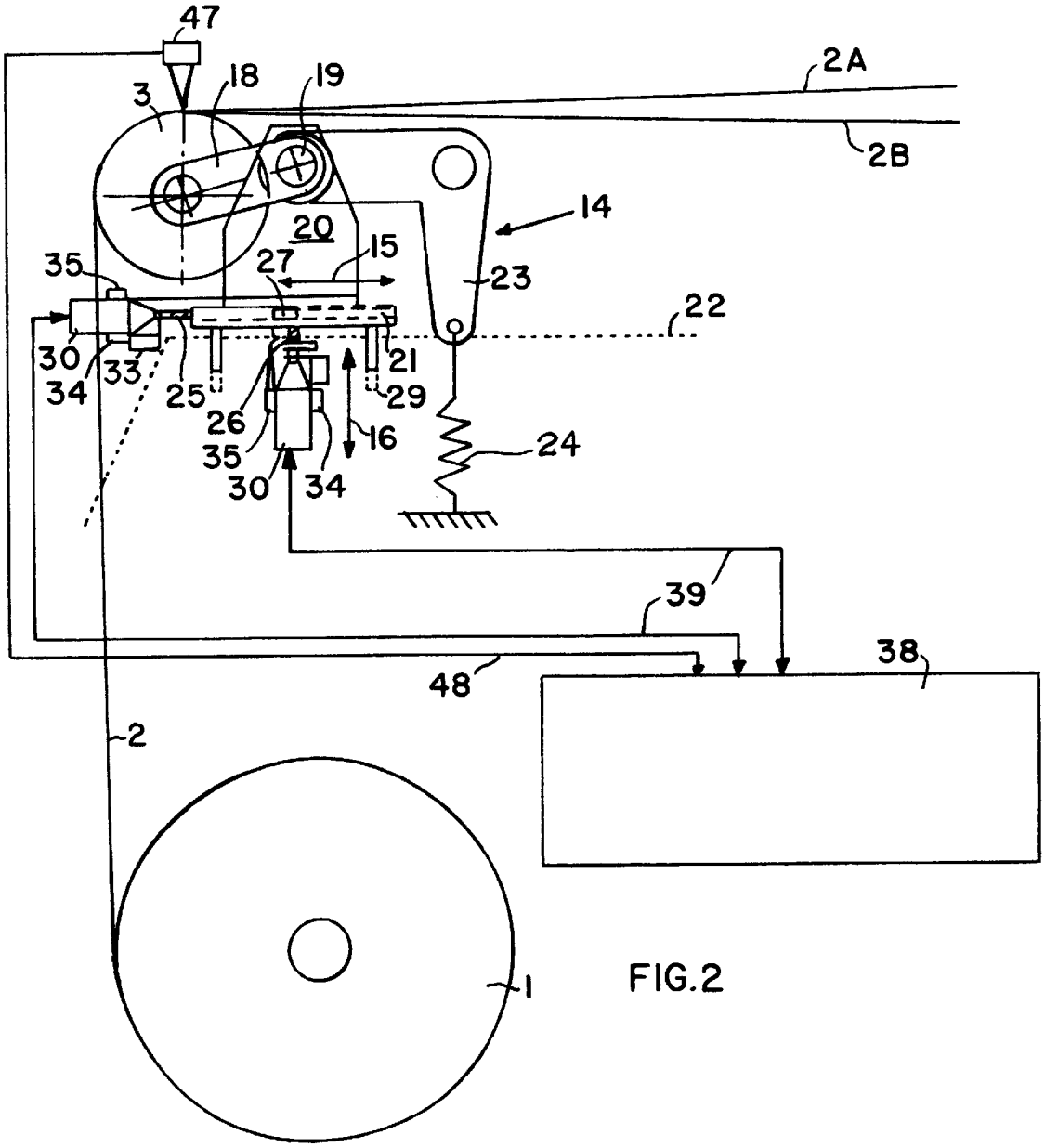
FIG. 2 shows a portion of a loom while illustrating the backrest with an adjustment device according to the invention, in a schematic sectional view.

The adjusting means that make it possible to adjust the backrest 3 are shown in detail in FIG. 2, which shows the bearing support of the backrest 3 and the associated adjusting means for one side of the machine. Basically, the backrest 3 is tiltably supported on both sides of the machine respectively by means of a connector plate 18 so as to be tiltable about a horizontal shaft 19, of which the ends are received in bearing parts that are embodied as horizontal carriages 20 which are movable in the horizontal direction indicated by arrows 15 and which are respectively supported on a vertical carriage 21. On each side of the machine, the vertical carriage 21 is vertically movably guided corresponding to the arrows 16 on the machine frame, of which a portion is shown and indicated by 22. Lever arms 23 of the warp thread tension compensating device 14 are coupled against rotation with the connector plates 18 carrying the backrest 3. Tension springs 24 engage the lever arms 23 to enable the backrest 3 to carry out an elastic warp tension compensating movement. The warp tension compensating device 14 is generally known as such and therefore does not need to be described in further detail.

The horizontal and vertical carriages 20, 21 forming a part of the adjusting means are respectively movable in the horizontal or vertical directions respectively by respective allocated self-locking drive transmissions. The self-locking drive transmissions in the present case are embodied as threaded spindle drive transmissions, of which only the operating elements in the form of threaded spindles 25, 26 are shown in FIG. 2.

The threaded spindle 25 of the horizontal carriage 20 is guided in the vertical carriage 21 and engages into a spindle nut indicated by 27 provided on the horizontal carriage 20. The threaded spindle 26, of which an end is coupled to the vertical carriage 21, cooperates with a spindle nut 28 (FIG. 3) arranged in a frame-fixed manner on the machine frame 22. The vertical frame-fixed guides of the vertical carriage 21 are indicated by 29 in FIG. 2.

Figure 4:
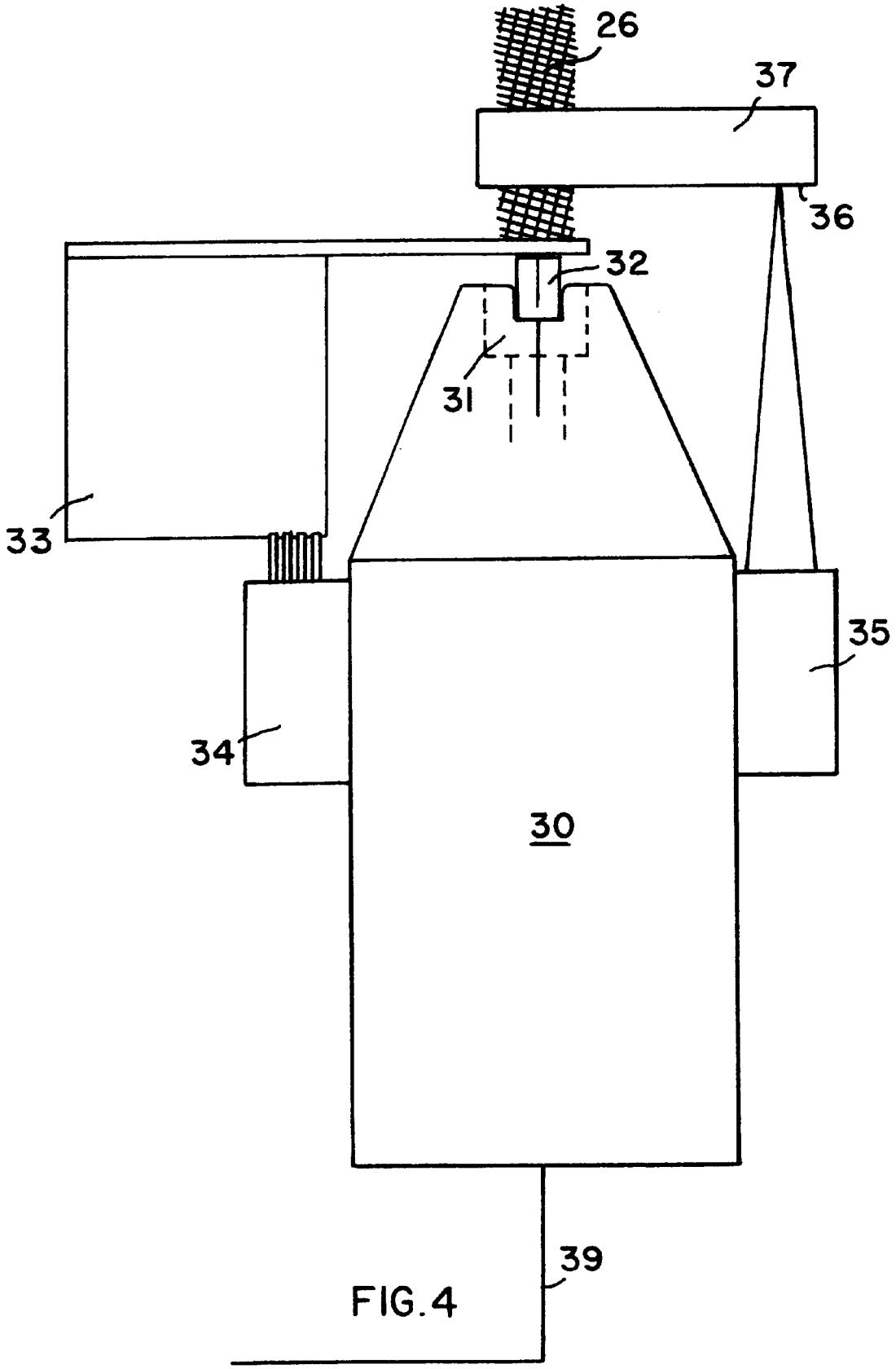
FIG. 4 shows the adjustment unit of the device for adjusting the backrest according to FIG. 2 or for adjusting the warp stop motion according to FIG. 3, in a schematic view in the state of being set onto a threaded spindle of the adjusting means, and in a different scale.

The two threaded spindles 25, 26 allocated to the two adjustment functions, namely the adjustment of the backrest 3 in the horizontal direction and in the vertical direction, are respectively operated by an adjusting device, which comprises an electric motor drive and is embodied as an adjusting unit 30, which is illustrated in enlarged detail in FIG. 4. The adjusting unit 30 is embodied as a movable unit and has a plug coupling arrangement indicated by 31 provided on its one terminal end, wherein this plug coupling arrangement 31 is coupled to its drive. By means of this plug coupling arrangement 31, the adjusting unit 30 can be plugged onto a coupling extension 32 of the threaded spindle 25 or 26, which has a cross-section of a polygonal shape, for example. When the drive unit 30 is held against rotation, in this manner the respective threaded spindle 25 or 26 coupled to the adjusting unit 30 can be operated for adjusting the backrest 3 or the warp stop motion 17.

A coding part 33, which for example carries a bar code, is fixedly allocated to each threaded spindle 25, 26. The coding of the coding part 33 is read by a code reader 34 arranged on the adjusting unit 30 that is plugged onto the respective threaded spindle 25 or 26. This coding is characteristic of the location and the adjusting function of the threaded spindle. In this manner, the coding arrangement formed by the coding part 33 and the code reader 34 can automatically recognize the location and the function of the respective threaded spindle. Moreover, a contact-free measuring system 35, in the form of an ultrasonic sensor or a laser measuring device for example, is arranged on the housing of the adjusting unit 30. The measuring system 35 automatically and without contact measures the respective existing distance position adjustment of the respective carriage 20 or 21 from a fixed reference point, i.e. the respective actual position of the carriage, in connection with a fixed reflector or reflection plane 36 which is formed on a reflector part 37 which is held by the threaded spindle 25 or 26 in a fixed spatial arrangement relative to the associated horizontal or vertical carriage 20 or 21.

The adjusting unit 30 is connected via control lines 39 or respectively a bus with an electronic control unit 38 of the loom, as which transmits to the adjusting unit 30 that is plugged onto the threaded spindle 25 or 26, data regarding the location (for example right or left side of the machine) and the adjusting function of the respective threaded spindle, as well as regarding the actual position of the carriage 20 or 21. In the control unit 38, the corresponding adjustment values are compared with nominal or desired values pertaining to the desired position of the backrest 3, which have been prescribed by an operator or which have been provided over a data network. Depending on the result of the comparison, an adjusting signal is generated, which the control unit 38 transmits to the drive of the adjusting unit 30, which in such a manner rotates the threaded spindle 25 or 26 coupled to it, so that the carriage 20 or 21 and therewith the backrest 3 is moved into its desired position.

In looms in which the warp 2 runs over a backrest which is pretensioned or loaded, for example with a spring 24, the position of the backrest and therewith the geometry of the back shed formed by the warp threads 2*a,* 2*b* will change responsive to the diminishing warp beam wrapping diameter. In this context, the altered entry of the warp threads from the backrest into the warp stop motion 17 is also a considerable disadvantage, because then the drop wires 40 of the warp stop motion are excited to carry out an increased uncontrolled movement, whereby the stopping response of the loom is negatively influenced in an enduring or ongoing manner. The change in the position of the backrest caused by the weaving-down or weaving-off of the warp beam 1 is detected as an actual position by means of a measuring arrangement 47, which is known as such, and is provided as an electrical signal representing the actual value through a line 48 to the control unit 38. This actual value is continuously compared to the value representing the desired position of the backrest, and consequently the necessary corrections for maintaining the desired position of the backrest are carried out by means of the adjusting unit 30.

Figure 3:
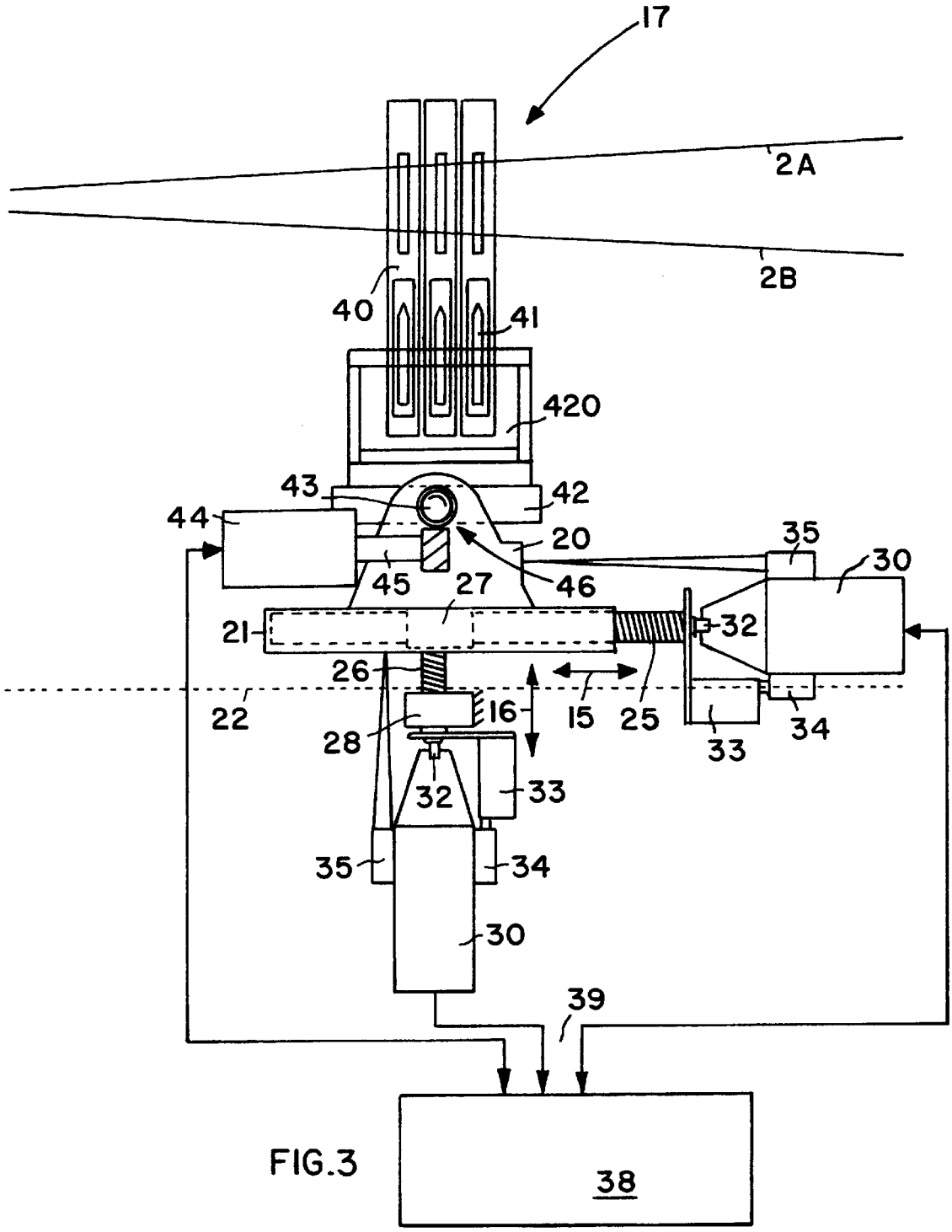
FIG. 3 shows a warp stop motion with an adjusting device according to the invention, in a schematic sectional view and in a broken out portion.

FIG. 3 shows the adjustment of the warp stop motion 17 carried out by corresponding adjusting means. These adjusting means are constructed in principle similarly to the adjusting means of the backrest 3 as described in connection with FIG. 2. Equivalent components are therefore provided with the same reference numbers and are not described again. The warp stop motion 17 is basically known in its construction and its function (see e.g. the book "Weberei" ("Weaving") by Dipl.-Ing. J. Schneider, Springer verlag publishers, 1961). It comprises the drop wires 40 sensing or monitoring the individual warp threads, wherein these drop wires 40 are guided to be movable up and down along rails 41. The warp stop motion 17 is arranged on a tilting table 42 with a frame member 420 that continuously extends across the width of the loom. The tilting table 42 is supported to be tiltable about a horizontal axis 43 on the horizontal carriage 20 of the adjusting means. A rotational drive 44 that is connected to the respective horizontal carriage 20 is coupled with the tilting table 42 and makes it possible to tilt or swing the tilting table 42 about the horizontal axis 43. The rotational drive 44 is connected to the control unit 38, from which it receives control signals that depend on the respective adjustment of the backrest 3. The control signals activate the rotational drive 44 to adjust the tilting table 42 in such a manner so that the drop wires 40 of the warp stop motion 17 take up the correct angular position relative to the warp threads 2*a*, 2*b* of the warp 2 that are respectively being monitored by the drop wires 40.

While the rotational drive 44 is embodied in the form of an adjustment device that is rigidly connected with the horizontal carriage 20 in the example embodiment shown in FIG. 3, varied embodiments are also imaginable in which the carriage-fixed rotational drive 44 is replaced by the movable adjusting unit 30.

In this case, the self-locking tilting drive 46 for the tilting table 42 is embodied as a worm gear drive, of which the operating means is formed by the pinion shaft 45, and this pinion shaft 45 is provided with a coupling extension 32 (FIG. 4) which allows the adjusting unit 30 to be plugged thereon.

In order to adjust the backrest 3 and/or the warp stop motion 17 in the above mentioned alternative case of the construction of the rotational drive 44, the adjusting unit 30 which is connected with the control unit 38 is sequentially set onto the individual threaded spindles 25, 26 or the pinion shaft 45. Its code reader 34 recognizes the location and the adjusting function of the respective threaded spindle or the pinion shaft 45 by means of the associated coding on the respective coding part 33. Depending on the adjustment data provided by the measuring system 35, the adjusting unit 30 receives from the control unit 38 the respective adjusting signals necessary for reaching the respective prescribed desired position.

The adjusting means for the backrest 3 and/or the warp stop motion 17 do not necessarily have to comprise carriages 20 and 21 that are movable in the horizontal and vertical direction. The inventive concept is also useable in the same manner for such looms in which the backrest is adjustably supported on the machine frame in a different manner, for example in a tiltable manner as illustrated in German Patent Publication DE 195 38 121 C1and corresponding U.S. Pat. No. 5,755,268.

The coding arrangement 33/34 can be omitted as the case may be, if it can be ensured in another manner, that the control unit 38 knows which adjusting function is currently respectively allocated to the adjusting unit 30.

Basically it is also possible to fixedly allocate individual adjusting devices, for example generally of the type like the adjusting unit 30, to the individual adjusting functions of the adjusting means of the backrest 3 and/or the warp stop motion 17, in order to be able to optimally adjust the backrest 3 and/or the warp stop motion 17 during production under the control of the control unit 38, for example for optimization in the context of warp thread breaks. Thus, for example, two adjusting units 30 can be allocated to the two threaded spindles 25 for the horizontal adjustment of the backrest 3 and/or the warp stop motion 17, in order to adjust the warp tension to the particular purpose by means of a corresponding adjustment of the backrest 3 in the case of a stoppage of the loom or upon the renewed start-up of the loom.

In addition to the described adjusting functions, the adjusting means of the backrest 3 and/or of the warp stop motion 17 may also comprise further adjusting functions, for example, for adjusting the pre-tension of the backrest 3 by means of the tension compensating device 14.

In any case, when a product article change is carried out, the invention makes it possible to achieve a rapid and exact readjusting of the backrest 3 and of the warp stop motion 17. Moreover, the adjustments are reproducible for a renewed weaving of the same product article.

Figure 5:
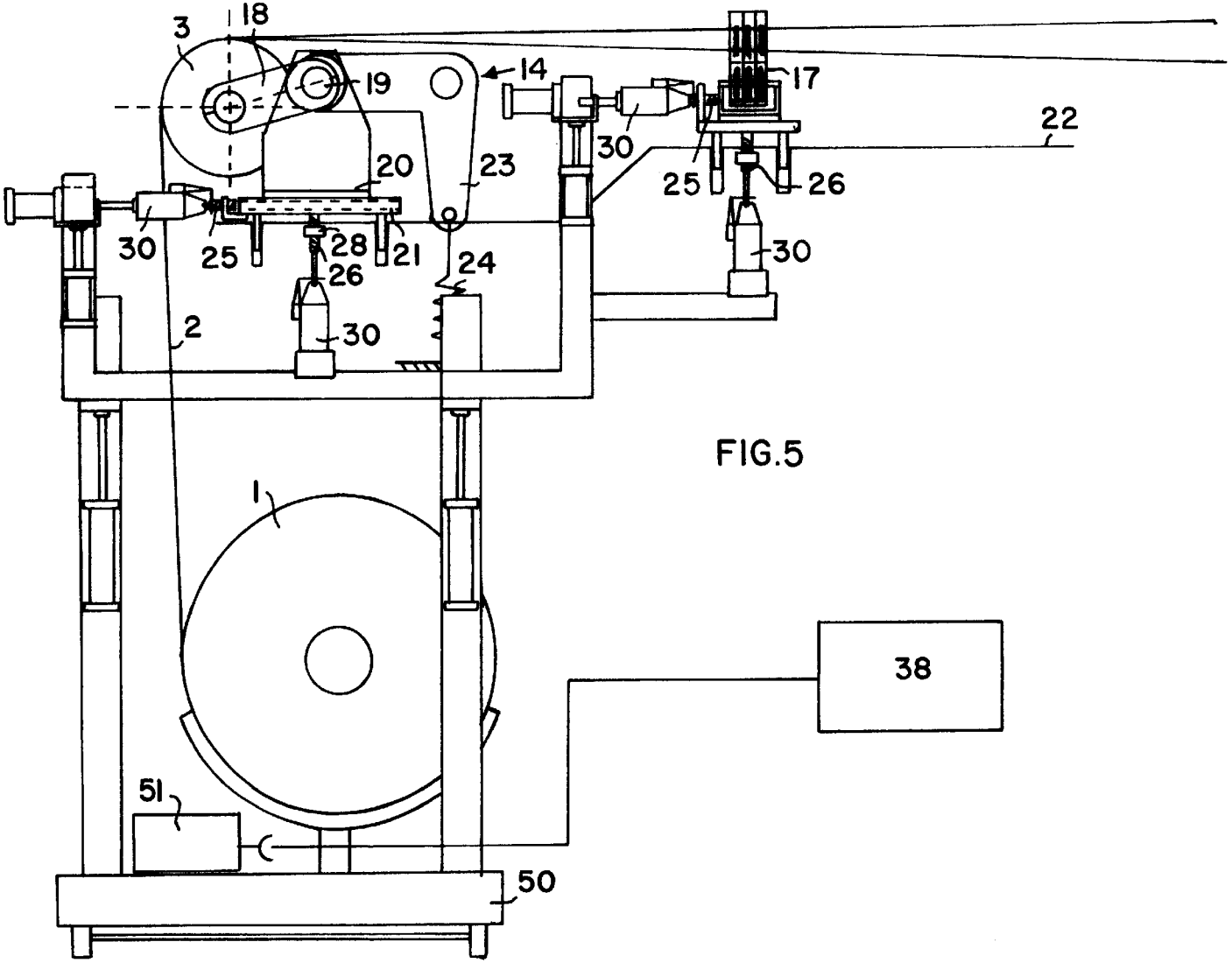
FIG. 5 shows a combination of the two portions of the loom shown in FIGS. 2 and 3, further with a robot carriage.

Since changes of the product article generally only take place at long time intervals, for economic reasons it may also be suitable to use a robot carriage 50, which is radio controlled for example, and which carries at least one adjusting unit 30 as shown in FIG. 5. In the case of a product article change, this robot carriage 50 drives to the loom in a floor-controlled manner and automatically and self-sufficiently carries out the respective required adjustment of the backrest 3 and of the warp stop motion 17, corresponding to the article data that have been transmitted to the loom via a network (for example the Dostyle System developed by Lindauer Dornier GmbH of Lindau, Germany), at least in connection with the left and right adjusting means that respectively belong together and provided to the onboard controller 51 of the robot carriage 50 from the control unit 38.

What is claimed is:

1. A method for adjusting a position of at least a backrest and/or a warp stop motion that are adjustably supported on a machine frame of a weaving loom and are movable from an actual position into a respective prescribed desired position and are fixable in the desired position by allocated adjusting means with at least one adjusting function, wherein the method comprises the following steps:

a) allocating at least one controllable driven adjusting device to the adjusting means, b) recognizing the respective adjusting function of the adjusting means, c) determining an existing actual position of the backrest and/or the warp stop motion, d) automatically comparing the actual position with a prescribed desired position, e) responsive to and dependent on the comparing, generating an adjusting signal required for moving the backrest and/or the warp stop motion into the desired position, and providing the adjusting signal to the adjusting device, and f) operating the adjusting device based on the adjusting signal to correspondingly operate the adjusting means to the extent necessary for adjusting the backrest and/or the warp stop motion to the desired position.

2. The method according to claim 1, wherein the adjusting device is a mobile adjusting device, and wherein the step a) comprises releasably coupling the adjusting device with the adjusting means and later decoupling the adjusting device from the adjusting means after the completion of the step f).

3. The method according to claim 1, wherein the step a) comprises fixedly allocating the at least one adjusting device to the adjusting means.

4. The method according to claim 1, wherein the adjusting means comprise at least two adjusting functions respectively adapted for generating adjusting movements in at least two different adjustment directions, wherein each of the adjusting functions has allocated thereto a respective coded identification, and wherein the step b) comprises reading the respective coded identification for recognizing the respective adjusting function.

5. The meth according to claim 1, wherein the determining of the actual position of the backrest and/or of the warp stop motion is carried out without physical contact.

6. The method according to claim 1, wherein the steps a) to f) are carried out one time for adjusting the position of the backrest and/or the warp stop motion in a horizontal direction using a first adjusting function of the adjusting means, and are carried out another time for adjusting the position of the backrest and/or the warp stop motion in a vertical direction using a second adjusting function of the adjusting means.

7. The method according to claim 6, wherein the adjusting of at least the backrest in at least the horizontal direction is carried out dependent on the warp tension upon stopping the loom and/or for changing the warp tension when starting the loom.

8. The method according to claim 1, wherein at least the steps d), e) and f) are carried out to readjust the position of at least the backrest by the adjusting means during the weaving process in order to reduce the warp thread breakage frequency.

9. The method according to claim 1, further comprising tilting the warp stop motion about a horizontal tilting axis by the adjusting means.

10. The method according to claim 1, wherein the recognizing of the respective adjusting function of the adjusting means and the determining of the actual position of the backrest and/or the warp stop motion comprises providing respective characteristic data to a control unit of the loom and processing the characteristic data in the control unit, and wherein the generating of the adjusting signal for the adjusting device is also carried out by the control unit.

11. The method according to claim 10, wherein the providing of the characteristic data for the desired position adjustment comprises transmitting the data via a network to the control unit of the loom.

12. The method according to claim 1, wherein the loom includes movable robot means comprising the adjusting device, and wherein the operating of the adjusting means is carried out using the movable robot means, comprising providing control data to the respective loom for the respective weaving process and controlling the robot means dependent on the control data.

13. A method for adjusting a position of at least a backrest which is arranged in a spring-loaded and adjustably supported manner and/or a warp stop motion which is adjustably supported on the machine frame of a loom that is further equipped with a loaded warp beam, wherein both the backrest and the warp stop motion are movable from an actual position into a respective prescribed desired position by allocated adjusting means with at least one adjusting function, wherein the method comprises the following steps:

a) permanently allocating at least one controllable driven adjusting device to the adjusting means, b) storing the prescribed desired position of the backrest and/or of the warp stop motion as a desired value in a control unit by means of the adjusting means, c) recognizing the respective adjusting function of the adjusting means, d) determining the existing actual position of the backrest and/or of the warp stop motion, e) weaving the warp off from the warp beam, and automatically and continuously comparing the actual position with the prescribed desired position in the control unit during the weaving-off of the warp from the warp beam, f) responsive to and dependent on the comparing, generating an adjusting signal that is required at least for moving the backrest for maintaining the geometry of the back shed constant, and providing the adjusting signal to the adjusting device, and g) operating the adjusting device based on the adjusting signal to correspondingly operate the adjusting means to the extent necessary for adjusting at least the backrest to the desired position.

14. An apparatus for adjusting a position of at least a backrest and/or a warp stop motion that are tiltably supported on the machine frame of a loom equipped with a loaded warp beam, the apparatus comprising:

adjusting means allocated to the backrest (3) and/or the warp stop motion (17) with at least one adjusting function for adjusting the position of the backrest and/or the warp stop motion in at least one adjustment direction, operating means (25, 26) of the adjusting means allocated to the at least one adjusting function, an adjusting device (30) for acting on the operating means of the adjusting means, which includes drive means for driving the operating means, means (33, 34) for recognizing the adjusting function of the respective operating means, means (35, 36, 47) for determining the respective existing actual position of the backrest (3) and/or of the warp stop motion (17), and a control unit (38) which is connected with the adjusting device and with the means for recognizing the adjusting function and the means for determining the position of the backrest and/or the warp stop motion, and which carries out a comparison of desired position data that are valid for the recognized adjusting function with data that are characteristic of the recognized adjusting function and of the determined actual position and that are received by the respective means, and which generates an adjusting signal responsive to and dependent on the comparison, and which delivers the adjusting signal to the adjusting device (30) for moving the backrest (3) and/or the warp stop motion (17) into a respective desired position identified by the desired position data.

15. The apparatus according to claim 14, wherein the adjusting device comprises a movable adjusting unit (30) including a drive, which adjusting unit is removably coupleable with the operating means (25, 26) of the respective adjusting function.

16. The apparatus according to claim 15, wherein the means (34) for recognizing the adjusting function of the adjusting means and/or the means (35) for recognizing the actual position of the backrest (3) and/or of the warp stop motion are arranged on the adjusting unit (30).

17. The apparatus according to claim 14, further comprising a code fixedly allocated to the adjusting means, and wherein the means (34) for recognizing the adjusting function comprise means for feeler-sensing or reading the code.

18. The apparatus according to claim 14, wherein the means (35) for determining the actual position comprise a non-contacting distance measuring device that does not physically contact the backrest and/or the warp stop motion.

19. The apparatus according to claim 14, wherein the adjusting means comprise bearing parts (20, 21) that are movably supported and allocated to the individual adjusting functions, and that include and are respectively adjustable via a self-locking drive, and that include a threaded spindle (25, 26) as the operating means.

20. The apparatus according to claim 19, wherein the adjusting device comprises a movable adjusting unit (30) which comprises coupling means (31) for rotationally secured coupling with the respective threaded spindle (25, 26).

21. The apparatus according to claim 19, wherein the bearing parts comprise carriages (20, 21) which are supported so as to be movable in a horizontal and/or vertical direction.

22. The apparatus according to claim 14, comprising at least two of the adjusting devices allocated to the adjusting means, by means of which at least the backrest (3) is adjustable at least in a horizontal direction during stopping and/or during restarting of the loom.

23. The apparatus according to claim 14, wherein the adjusting means are adapted to be readjusted by the adjusting device via the operating means during a weaving process for minimizing the warp thread breakage frequency and for maintaining constant the geometry of a back shed formed in the loom.

24. The apparatus according to claim 14, wherein the warp stop motion (17) is tiltable by the adjusting means.

25. The apparatus according to claim 14, further comprising a robot carriage which comprises an apparatus for receiving the adjusting signals generated by the control unit (38) and on which the adjusting device is arranged.

* * * * *

UNITED STATES PATENT AND TRADEMARK OFFICE
CERTIFICATE OF CORRECTION

PATENT NO. : 6,135,162

DATED : October 24, 2000

INVENTOR(S) : Dornier et al.

It is certified that error appears in the above-identified patent and that said Letters Patent is hereby corrected as shown below:

On the Title Page: under [54], line 3, before "OF", delete "POSITION";
under [75], line 1, after "Dornier,", replace "Nonnenborn;" by --Nonnenhorn;--;

Col. 9, line 14, after "The", replace "meth" by --method--.

Signed and Sealed this

Eighth Day of May, 2001

*Attest:*

*Attesting Officer*

NICHOLAS P. GODICI

*Acting Director of the United States Patent and Trademark Office*